United States Patent [19]

Matthews

[11] Patent Number: 4,850,052

[45] Date of Patent: Jul. 25, 1989

[54] GLOVE FOR SPORTING EVENT SPECTATOR

[76] Inventor: Gregory Matthews, 777 Bellflower Blvd., Long Beach, Calif. 90815

[21] Appl. No.: 230,866

[22] Filed: Aug. 11, 1988

[51] Int. Cl.[4] ..... A41D 19/00

[52] U.S. Cl. ..... 2/160; 2/DIG. 6; 2/161 A

[58] Field of Search ..... 2/159, 160, 161 A, 161 R, 2/162, 163, DIG. 6

[56] References Cited

U.S. PATENT DOCUMENTS

| | | | |
|---|---|---|---|
| 137,988 | 4/1873 | Whipple | 2/160 |
| 786,006 | 3/1905 | Cooper | 2/160 |
| 1,504,836 | 8/1924 | Rehn | 2/160 |
| 1,613,664 | 1/1927 | Lewandowski | 2/160 |
| 1,670,176 | 5/1928 | Woolery | 2/159 X |
| 2,103,594 | 12/1937 | Murray | 2/160 |
| 2,421,412 | 6/1947 | Dodge | 2/160 |
| 2,496,734 | 2/1950 | Macreadie | 2/160 |
| 3,624,686 | 11/1971 | Beals | 2/DIG. 6 X |

FOREIGN PATENT DOCUMENTS

| | | | |
|---|---|---|---|
| 650441A | 7/1985 | Switzerland | 2/159 |
| 12636 | of 1902 | United Kingdom | 2/160 |
| 104423 | 3/1917 | United Kingdom | 2/160 |

*Primary Examiner*—Werner H. Schroeder
*Assistant Examiner*—Sara M. Current
*Attorney, Agent, or Firm*—Charles H. Thomas

[57] ABSTRACT

A sporting event novelty device is comprised of a glove adapted for use by a spectator attending a sporting event. The novelty glove envelops the hand of a spectator and has a pocket located on its front side in spaced separation from the fingers and thumb of the glove. A piece of cloth colored the same color as the color of an official's penalty flag for the sporting event attended by the spectator is removably concealed within the pocket for withdrawal therefrom at the option of the spectator. The cloth may be spread across the front side of the glove and releasably secured thereto by mating hook and loop fabric fasteners. Display of the cloth in this manner by the spectator symbolizes the observation of a rule infraction by the spectator.

12 Claims, 1 Drawing Sheet

GLOVE FOR SPORTING EVENT SPECTATOR

BACKGROUND OF THE INVENTION

1. Field of the Invention

The present invention is a novelty device designed for use by a spectator of a sporting event in which rule infractions by the players are signaled by officials using flags of a distinctive color. The device is particularly suitable for use by spectators attending a football game.

2. Description of the Prior Art

Spectators throughout the world attend sporting events for numerous different types of sporting contests. Usually such sporting contests are conducted before large crowds of spectators who are seated in a stadium or in stands which at least partially encircle a playing field. The spectators who attend such sporting events use the opportunity of attending the sporting contest as an important form of relaxation and as an opportunity for enjoying an emotional release.

Spectators at sporting events derive great satisfaction and relief from applauding the activities of players in the contest who perform sporting maneuvers which are particularly well done or which result in a score for a favorite team. Such satisfaction is typically expressed by a clapping of hands, cheering, shouts of approval or all of the above.

On the other hand, a spectator experiences a sense of emotional frustration upon observing rule infractions or unsportsman-like conduct by a player of an opposing team. This sense of emotional frustration is heightened when officials who are charged with ensuring that the rules of the contest are obeyed fail to detect or to penalize an opposing team for a rule infraction. In the past, spectators have only been able to express their frustration and outrage in such a situation by means of vocal noises, such as booing and hissing, and by means of hand gestures. However, while such vocalization and gesturing is recognizable by others as a disappointed reaction, the available spectator outlets can often be construed as only a general dissatisfaction or disappointment with the course of events in the sporting contest.

SUMMARY OF THE INVENTION

The present invention is designed to provide a sporting event spectator with a device by means of which the spectator can unequivocally convey a feeling of outrage or unfairness with respect to a specific rule infraction that may or may not have been detected by an official charged with enforcing the rules of the sporting contest. The device of the invention allows the spectator to present a form of protest to a particular act of conduct on the part of the participant in a sporting event, as distinguished from a more generalized reaction of disappointment or frustration.

In a broad aspect the present invention is a sporting event novelty device for symbolizing the observance of a rule infraction by a spectator at a sporting event at which the assessment of a penalty for a rule infraction is signaled by an official by display of a penalty flag of distinctive coloring. For example, in the sport of football a rule infraction which warrants a penalty is signaled by an official who throws a bright yellow flag on the playing field in the vicinity of the location in which the rule infraction occurred. The device of the invention is comprised of a glove worn by a spectator and having fingers, a thumb, a front side, and a back side with a pocket formed in the front side, and a piece of sheet material having the same aforesaid distinctive coloring as is used by an official in the assessment of a penalty. The sheet of material is located in the pocket of the glove for at least partial withdrawal therefrom by the spectator to express the observation by the spectator of a rule infraction warranting assessment of a penalty.

The use of the device of the present invention by a single spectator provides that spectator with an emotional outlet and the knowledge that his or her expression of indignation can be observed by others as being directed at a particular event that occurred during the contest. The use of the device by a large number of spectators will have a far more powerful effect, however. That is, the display of a distinctively colored sheet of material by a spectator might well go unnoticed by officials charged with enforcing adherence to the rules of the sporting contest. On the other hand, the concurrent display of a substantial number of uniformly colored sheets of material having the same color as an official penalty flag using the device of the invention by many spectators can leave no doubt as to the sentiment being expressed by them at a specific failure to assess a penalty.

The primary purpose of the device of the invention is to provide an emotional outlet for sporting event spectators which can be directed toward failure of game officials to assess a penalty with respect to a particular act or conduct that occurs in a sporting contest. Because the device of the invention creates a vivid display which is unquestionably associated with a particular occurrence in the sporting contest, the concurrent display of a colored sheet of material by large numbers of spectators may have the secondary effect of constructive introspection regarding the assessment of penalties on the part of the game official charged with this duty. A further secondary result of use of the invention is an expression to the media covering the sporting event of the sentiment of a large number of spectators with respect to a particular act or conduct on the part of a participant in the sporting event.

In the preferred embodiment of the invention, some means is provided for maintaining a piece of distinctively colored material fully extended, and in a substantially flat position as it is being displayed by a spectator. If maintained in this condition, the sheet of colored material is visible at a far greater distance than if it is merely seized by the thumb and index finger of the user and waved in the air. Accordingly, the preferred embodiment of the invention is further comprised of a means for holding the sheet of material spread flat against the palm and outstretched thumb and fingers of the glove of the invention. Flexible fabric hook and loop fasteners of the type utilized in other unrelated applications are ideally employed for this purpose.

In the preferred embodiment, first pads of a flexible, fabric hook and loop fastener are secured to the tips of the thumb and the tips of at least some of the fingers of the glove of the invention. Second pads of the flexible, fabric hook and loop fastener are engageable with the first pads and are located on one side of the sheet of material so as to lie in juxtaposition with the first pads on the thumb and fingers of the glove when the thumb and fingers of the glove are spread apart and placed against that side of the sheet of material on which the second pads are located. Because the hook and loop fasteners of this type are formed of a flexible, resilient fabric, they do not pose any impediment to folding of the sheet of material for storage in the pocket of the glove. Neither do they pose any impediment to folding of the glove and sheet of material together for storage in a garment of the spectator.

For ease in storing the sheet of distinctively colored material the pocket on the glove is located on the front or palm side of the glove, and may be advantageously formed in either the wrist or the palm of the glove. The sheet of distinctively colored material may be easily withdrawn and reinserted into a pocket located in either of these areas.

The sheet of material employed in the novelty device of the invention is preferably a thin, lightweight sheet formed either of fabric or plastic. Preferably, the sheet does not absorb a great deal of water so that it is not uncomfortable when positioned in the pocket of the glove in inclement weather. For this reason the preferred embodiments of the invention may employ sheets of nylon material which are colored with the same color utilized for penalty flags in officiating the sporting contest. In the sport of football, as played in the United States and Canada, the sheet of material should be bright yellow in color.

The size of the sheet of material should be generally about the size of the breadth of the glove when the thumb and fingers are spread apart, as the fabric hook and loop fasteners on the thumb and fingertips of the glove can then hold the sheet of material fully displayed. However, it is to be understood that the sheet of material may also be used for displaying a team logo in the colors of the favorite team. Also, the sheet of material may be shaped in the form of a pennant, or configured in the shape of an object utilized in the sport being played, such as the shape of a football or basketball.

It may well be advantageous for the opposite sides of the sheet of material to bear different colors or designs for use in expressing different spectator emotions. For example, one side of a sheet of material in an embodiment of the invention designed for use by a spectator at a football game can be colored bright yellow, to symbolize an official's penalty flag. The opposite side of the sheet of material may bear the logo of the favorite team. Thus, the device of the invention so constructed can be employed with the bright yellow side facing outwardly to express indignation at the failure of an official to assess a penalty in a particular instance. Alternatively, the sheet of material can be positioned in reverse fashion across the front side of the glove to display the logo of a favorite team, to express general approval or encouragement to that team. When the sheet of material is to be used in a reversible manner like this, both sides of the sheet should be provided with flexible hook or loop type fasteners pads of the type described.

The glove of the novelty device of the invention likewise should be constructed of a material which is somewhat porous, but which does not absorb a great deal of moisture. Thus, the glove will not entrap perspiration on the hand of the wearer, and will not become heavy and soggy during inclement weather. Preferably also, the material of which the glove is constructed is somewhat elastic, so that it will stretch to fit different sizes of hands. Nylon Spandex is an excellent material for use in constructing a glove according to the invention.

The glove of the novelty device of the invention may be colored a neutral shade, such as plain white. Alternatively, it may be colored with the colors of a favorite team. Also, the glove may bear particular designs and colors associated with officials of the sporting event with which the device of the invention is to be used. For example, in the sport of football persons officiating the game all wear tunics or jackets covered with vertically oriented, alternative black and white stripes. Accordingly, to create a symbolic association with officiating of a game of football, the glove of the novelty device of the invention may be colored with alternating black and white stripes extending from the fingers to the wrist.

The invention may be described with greater clarity and particularity by reference to the accompanying drawings.

DESCRIPTION OF THE EMBODIMENTS

Figure 1:
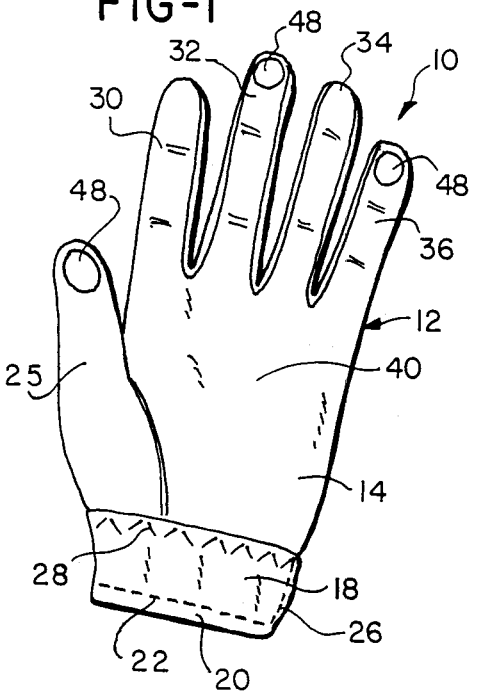
FIG. 1 is a front elevational view of the glove of a device of the invention designed for use by a spectator at a sporting event.

FIG. 1 illustrates a novelty device 10 by a spectator for use on the left hand at a sporting event in which rule infractions by players are signaled by officials using flags of a distinctive color. A corresponding device 10' for use on the right hand of the spectator is visible in FIG. 2. Each of the devices 10 and 10' is comprised of a glove 12 for enveloping the hand of a spectator. Each glove 12 has a front side 14, a back side 16, and a pocket 18 located on the front side 14. The glove 12 includes a thumb 25, an index finger 30, a middle finger 32, a ring finger 34 and a little finger 36, along with a palm 40 and the wrist 20.

Each pocket 18 of each glove 12 depicted in FIGS. 1–4 is formed in the wrist 20 of the glove 12 as a band of fabric, approximately two inches in width and extending entirely across the front side of 14 at the wrist 20. The pocket 18 is secured to the fabric of the glove 12 by a line of stitching 22 along the lower extremity of the wrist 20 and along the sides by lines of stitching 24 adjacent the glove thumb 25, and a line of stitching 26 along the heel of the palm 40 of the glove. The top edge of the fabric forming the pocket 18 is folded over and reinforced by a line of zigzag stitching indicated at 28. The pocket 18 is thereby closed at its bottom and sides by the lines of stitching 22, 24 and 26 and is open at the top.

Within the pocket 18 on the front side 14 of each glove 12 there is a piece of nylon cloth 42 which is of the same distinctive color as the color of flags used by officials in the sporting contest to assess penalties. The novelty devices 10 are designed for use by spectators of football games, so that each piece of cloth 42 is bright yellow in color.

Figure 2:
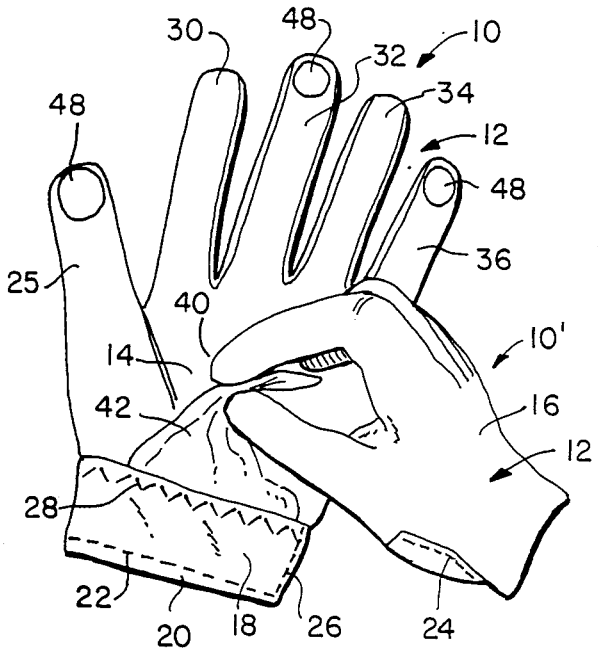
FIG. 2 shows the manner in which the sheet of material is withdrawn from the glove of the device of FIG. 1.
Figure 3:
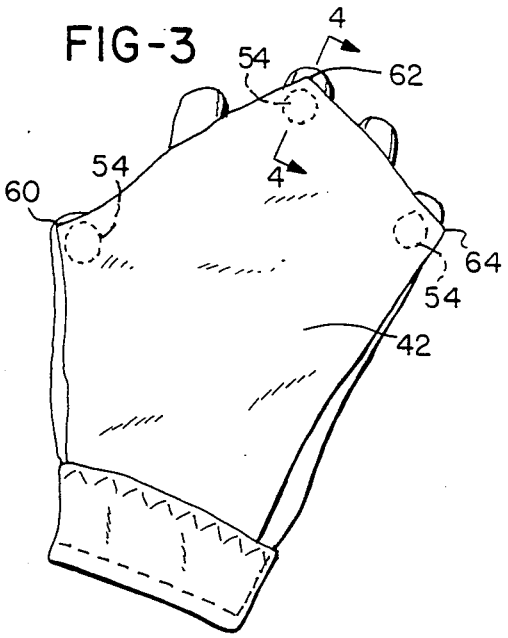
FIG. 3 illustrates the manner in which the sheet of material is fully displayed on the glove of FIG. 1.

FIG. 3 illustrates the manner in which the bright yellow nylon sheet 42 is deployed for display. Since the sheet 42 is formed of a flexible fabric, some means is preferably employed to hold it spread across the front side 14 of the glove 12 in the manner illustrated in FIG. 3. Preferably, this means takes the form of a plurality of first type of pads 44 of contact fasteners which may be male-type hook and loop fastener pads sold under the registered trademark Velcro. One of the first type of pads 44 is depicted in detail in FIG. 4. As illustrated, each pad 44 bears a multiplicity of minute, resilient fabric hooks 46. The novelty device 10 also includes a plurality of a second type of pads 48 of contact fasteners, all of which are visible in FIGS. 1 and 2, and one of which is visible in detail in FIG. 4. The pads 48 are designed for releasable, mating engagement with the pads 44. Each of the pads 48 bears a looped fabric pile, visible at 50 in FIG. 4. The fabric pile 50 releasably engages the fabric hooks 46 of the first pads 44 upon contact between the hooks 46 and the pile 50.

The pads of one of the first and second types of pads are secured to the tip of the thumb 25 of the glove 12 on the front side 14 thereof and to the tips of at least some of the fingers of the glove 12 on the front side 14 thereof. In the embodiments illustrated, the pads 48 of the second type are secured to the tips of the thumb 25, the middle finger 32 and the little finger 36. The pads 48 on the thumb 25, and the fingers 32 and 36 thereby lie in a pattern when the thumb 25 and fingers 30, 32, 34 and 36 are spread apart.

The pads 44 of the other, first type of pads are secured to one side, namely the underside 52 of the cloth 42, in spaced separation from each other. The pads 44 reside in the same pattern as the pads 48 so as to be congruent to the pads 48 on the thumb 25 and fingers 32 and 36 when the thumb 25 and fingers 30, 32, 34 and 36 are spread apart and when the distinctively colored material 42 is disposed in juxtaposition thereagainst in the manner depicted in FIGS. 3 and 4.

Figure 4:
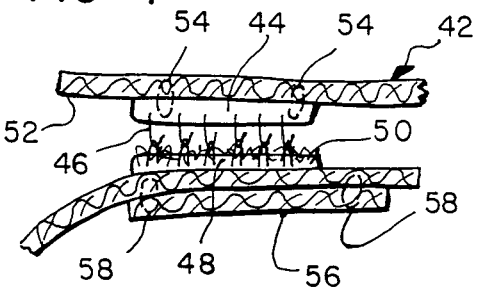
FIG. 4 is a sectional detail taken along the lines 4—4 of FIG. 3.

The pads 44 are secured to the underside 52 of the sheet of cloth 42 by generally circular lines of stitching indicated at 54 in FIGS. 3 and 4. The pads 44 are of a circular configuration, about one half inch in diameter.

The pads 48 are likewise of circular configuration and are also about one half inch in diameter. Preferably, the pads 48 are mounted on backing layers 56 which are disposed within the thumb 25 and fingers 32 and 36 of the cloth 12, as depicted in FIG. 4. The backing layers 56 are sewn to the fabric of the fingertips by lines of stitching indicated at 58 in FIG. 4. Openings are defined in the front sides of the thumbs 25, middle finger 32 and the little finger 36, at the tips thereof of a size and configuration conforming to that of the circular pads 48. The pads 48 thereby protrude through these openings so that the pile 50 thereof releasably engages with the hooks 46 when the pads 44 are brought into juxtaposition therewith.

By mounting the pads 48 in the manner described, the apparent thickness of the surface of the glove 12 is not increased, and the difference between the surface texture of the pile 50 of the pads 48 and the nylon Spandex fabric of which the fingers of the glove 12 are constructed is largely unnoticeable. Therefore, when the piece of material 42 is concealed within the pocket 18 in the embodiment of FIGS. 1–4, it is not readily apparent that the glove 12 has any special purpose, and indeed the gloves 12 can be used as normal gloves for warmth.

The sheet of bright yellow material 42 is of a generally irregular pentagon shape which more or less conforms in size and configuration to the breadth of the glove 12 when the thumb 25 and fingers 30, 32, 34 and 36 are spread apart. One edge of the sheet of material 42 is preferably secured within the pocket 18 at the bottom thereof by the line of stitching 22, so that the sheet of material 42 is permanently attached to the glove 12.

When a spectator observes a conduct or act believed to constitute a rule infraction warranting the assessment of a penalty, the spectator wearing the gloves 10 and 10' withdraws the cloth sheet 42 from its concealed location in the pocket 18, as depicted in FIG. 1, with the fingers of one hand, as depicted in FIG. 2. The user pulls the sheet of material 42 reasonably taut so as to bring the male hook and loop contact pads 44 into juxtaposition with the mating female contact pads 48. As soon as the pads 44 and 48 are pressed together, the hooks 46 engage the pile 50, so that the exposed corners 60, 62 and 64 of the sheet of material 42 are releasably secured to the thumb 25, middle finger 32 and little finger 36, respectively to hold the sheet of material 42 fully extended, as illustrated in FIG. 3. The spectator thereupon waves the glove 12 in the air, with the bright yellow sheet 42 fully exposed, to signify that a penalty should be assessed. When the spirit of the moment has passed, the corners 60, 62 and 64 are merely pulled away from the thumb 25, and the fingers 32 and 36, and the sheet 42 of material is stuffed back into the pocket 18 for storage or similar later use on a comparable occasion.

Figure 5:
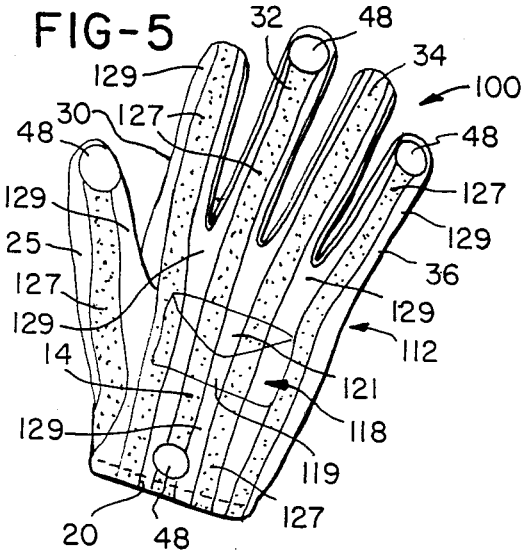
FIG. 5 is an elevational view of an alternative embodiment of the invention.

FIG. 5 illustrates an alternative embodiment 100 of the novelty device of the invention. The device 100 is similar in most material respects to the device 10, and corresponding elements of those structures have been labeled with the same reference numbers. The device 100 differs from the device 10 in several respects, however. The glove 112, like the glove 12, is equipped with a thumb 25, an index finger 30, a middle finger 32, a ring finger 34 and a little finger 36 as well as a palm 14 and a wrist 20. In the glove 112, however, the pocket 118 is located in the palm 14, rather than at the wrist 20. The pocket 118 includes a body 119 which is sewn about its sides and lower edge to the palm 114 of the glove. The pocket 118 also includes a flap 121 which folds over the open top of the pocket body 119. The flap 121 is preferably releasably secured to the top of the outer surface of the body 119 by means of hook and loop fasteners of the same type as that depicted in FIG. 4.

Because the pocket 118 located in the palm 114, rather than at the wrist 20 of the glove 112, the sheet of material 42 disposed therein is not sewn into the bottom of the pocket, as in the embodiment of FIGS. 1–4, but rather is completely removable from the pocket. That piece of cloth is the same as the cloth piece 42 depicted in FIG. 3 but it also includes an extra male hook-type contact pad 44 at its bottom edge. This extra pad 44 is releasably engageable with a corresponding pad 48, located in the wrist 20 of the glove 112 when the fabric piece is fully deployed in the manner depicted in FIG. 3.

The glove 112 also differs from the glove 12 in its decorative coloring. Specifically, the glove 112 is colored with alternating black stripes 127 and white stripes 129 which extend from the thumb 25 and the fingers 30–36 to the wrist 20. With the longitudinal black and white stripes 127 and 129, the glove 112 immediately brings to mind the similar coloring of the jackets and tunics worn by the officials of a football game. When the piece of material 42 is deployed across the front side 14 of the glove 112, the black and white stripes 127 and 129 are at least partially visible on the back side of the glove 112. The association between the brightly yellow colored fabric piece 42 and the black and white stripes 127 and 129 of the glove 112 upon which the fabric piece 42 is releasably secured is unmistakable.

Undoubtedly, numerous variations and modifications of the invention will become readily apparent to those familiar with spectator sporting events. For example, it is to be understood that the sheet of material 42 could be constructed with congruent male Velcro pads 44 on both its underside 52 and the opposite side 53. The side 52, which is the underside in the embodiments of FIGS. 1–4, could therefore be covered with a team emblem or colored with team colors. The fabric piece 42 could therefore be reversibly deployed across the front side 14 of the glove 112. Accordingly, the scope of the invention should not be construed as limited to the specific embodiments illustrated and described herein, but rather is defined in the claims appended hereto.

I claim:

1. A device for use by a spectator of a sporting event in which rule infraction by players are signaled by officials using flags of a distinctive color comprising a glove including a thumb, an index finger, a middle finger, a ring finger, a little finger, a palm and a wrist, for enveloping the hand of a spectator and having a front side, and a back side, a pocket located on the front side of said glove at said wrist, and a piece of cloth of the same aforesaid distinctive color disposed within said pocket and permanently secured to said glove at a location within said pocket for withdrawal therefrom to symbolize a rule infraction that has been observed by said spectator.

2. A device according to claim 1 further comprising a plurality of a first type of pads of contact fasteners each bearing a multiplicity of minute, resilient, fabric hooks and a plurality of a second type of pads of contact fasteners each bearing a looped fabric pile which releasably engages said fabric hooks of said first type of pads upon contact therewith, and the pads of one of said first and second types are secured to the tip of said thumb of said glove on the front side thereof and to the tips of at least some of said fingers of said glove on the front side thereof, so that said pads on said thumb and said fingers lie in a pattern when said thumb and said fingers are spread apart, and the pads of the other of said first and second types are secured to at least one side of said cloth in spaced separation from each other in the same aforesaid pattern so as to be congruent to said pads on said thumb and said fingers when said thumb and said fingers are spread apart and when said cloth is disposed in juxtaposition thereagainst.

3. A device according to claim 1 wherein said distinctive color is bright yellow.

4. A sporting event novelty comprising a glove adapted for use by a spectator attending a sporting event and having fingers, a thumb, a front side forming a palm, a back side and a wrist, a pocket located on said front side of said glove in spaced separation from said fingers and from said thumb, and a piece of cloth colored the same color as the color of an official's penalty flag for a predetermined sport and removably concealed within said pocket for at least partial withdrawal therefrom at the option of said spectator, and further comprising first pads of flexible, fabric hook and loop fasteners secured to the tips of said thumb and at least some of said fingers of said glove and second pads of flexible, fabric hooks and loop fasteners matingly engageable with said first pads and secured on a single side of said cloth to concurrently engage said first pads when said thumb and said fingers of said glove are spread apart so as to maintain said piece of cloth in a condition spread across said palm and fingers on the front side of said glove.

5. A sporting event novelty according to claim 4 wherein said pocket is located at said wrist on said front side of said glove.

6. A sporting event novelty according to claim 5 wherein said piece of cloth has an edge which is secured by stitching to said glove within said pocket.

7. A sporting event novelty according to claim 4 wherein the aforesaid color is bright yellow.

8. A sporting event novelty according to claim 7 wherein said glove is colored with alternating black and white stripes extending from said fingers to said wrist.

9. A device for symbolizing the observance of a rule infraction by a spectator at a sporting event at which the assessment of a penalty for a rule infraction is signaled by an official by display of a penalty flag of distinctive coloring comprising a glove worn by a spectator and having fingers, a thumb, a front side, a back side with a pocket formed in said front side, and a piece of sheet material having the same aforesaid distinctive coloring and located in said pocket for at least partial withdrawal therefrom by said spectator to express the observation by said spectator of a rule infraction warranting assessment of a penalty, and further comprising first pads of flexible, fabric hook and loop fasteners secured to the tips of said thumb and the tips of at least some of said fingers and second pads of said flexible, fabric hook and loop fasteners which are engageable with said first pads located on one side of said sheet of material so as to lie in juxtaposition with said first pads on said thumb and fingers of said glove when said thumb and fingers of said glove are spread apart and placed against one side of said sheet material.

10. A device according to claim 9 wherein the aforesaid distinctive coloring is bright yellow.

11. A device according to claim 10 wherein said pocket is formed in said wrist of said glove and said sheet of material is permanently attached to said glove at a location within said pocket.

12. A device according to claim 10 wherein said front side of said glove forms a palm and said pocket is formed in said palm.

* * * * *